United States Patent [19]

Zitser et al.

[11] 4,285,599

[45] Aug. 25, 1981

[54] APPARATUS FOR PREPARATION OF FLUIDIZED SAND

[76] Inventors: Vitaly A. Zitser, ulitsa Pervomaiskaya, 9/4, kv. 17, Dolgoprudny Moskovskoi; Leonid V. Bachelis, Schelkovskoe shosse, 91, korpus 2, kv. 221, Moscow; Jury E. Morozov, Leninsky prospekt, 39/1, kv. 264, Moscow; Alexandr V. Melnikov, ulitsa Dorozhnaya, 7, korpus 1, kv. 138, Moscow; Vladimir A. Ivanov, ulitsa Rustaveli, 3, korpus 6, kv. 34, Moscow; Igor I. Dreishev, Volgogradsky prospekt, 181, kv. 33, Moscow; Eduard G. Shartner, ulitsa Krylova, 4a, kv. 21, Karaganda; Vladimir D. Abaskalov, bulvar Mira, 47, kv. 30, Karaganda; Vladimir A. Levinson, ulitsa N. Abdirova, 46/2, kv. 47, Karaganda, all of U.S.S.R.

[21] Appl. No.: 65,507

[22] Filed: Aug. 10, 1979

[51] Int. Cl.[3] ..... B28C 7/04

[52] U.S. Cl. ..... 366/17; 366/34

[58] Field of Search ..... 366/15, 16, 18, 19, 366/20, 21, 33, 34, 40

[56] References Cited

U.S. PATENT DOCUMENTS

| | | | |
|---|---|---|---|
| 2,709,843 | 6/1955 | Hartley | 366/17 |
| 2,863,191 | 12/1958 | Dietert | 366/17 |
| 3,070,858 | 1/1963 | Deacon | 366/17 X |
| 3,082,497 | 3/1963 | Michalowski | 366/17 X |

FOREIGN PATENT DOCUMENTS

| | | | |
|---|---|---|---|
| 2033068 | 7/1970 | Fed. Rep. of Germany | 366/17 |
| 7246462 | 5/1974 | Fed. Rep. of Germany | 366/17 |
| 2165870 | 5/1975 | Fed. Rep. of Germany | 366/17 |
| 1288860 | 2/1962 | France | 366/17 |

*Primary Examiner*—Edward J. McCarthy

*Attorney, Agent, or Firm*—Fleit & Jacobson

[57] ABSTRACT

A characteristic feature of the invention lies in that a container for each liquid component, incorporated in a sand machine, is provided with an actuator intended for effecting forcible opening of the container spring-loaded valve, a device for controlling this actuator, and an eccentric mounted on the shaft of a drive for actuating feeders and acting on the control device; each proportioner for a fluid component is provided with spring-loaded diaphragms, of which one is adapted to control a feeder for loose components and the other, to close the feeder outlet. The connection between the feeders is effected by an intermediary member connected with the spring-loaded diaphragm and brought in contact with a cam mounted on the shaft of the drive for feeders and set at an angle of 2 to 15 deg. relative to the eccentric.

2 Claims, 5 Drawing Figures

APPARATUS FOR PREPARATION OF FLUIDIZED SAND

BACKGROUND OF THE INVENTION

1. Field of the Invention

The present invention relates to foundry practice and more in particular to the preparation of foundry- and core sands.

The invention is readily adaptable for use at mass-production plants of the sanitary engineering industry, automobile industry, machine-building and other industries.

2. Description of the prior art

Extensive use has been made of machines for preparing fluidized self-setting sands. For example, a wide variety of such machines is produced at works of the foundry-engineering industry. This type of machine comprises sand hoppers, feeders and proportioners of loose ingredients, tanks and feeders for liquid components, and a mixer. The prior-art machine operates in the following manner.

A loose component is fed from the sand hopper to the proportioner, and thence to the mixer. A liquid component is fed from the tank to a respective proportioner and from there to the mixer. Mounted at the inlets and outlets of the proportioners are gates and valves provided to ensure a uniform feeding and metering of the sand components. The prepared sand is periodically delivered from the mixer through a discharge port specially formed therein. A great number of drives, as well as the necessity to ensure a requisite interaction therebetween, renders this machine rather complicated in construction and operation, increasing the possibility of failure in automatic feeding of the sand components to the mixer in a present ratio.

There is known another machine for the preparation of a fluidized sand. This machine comprises a hopper and a proportioner for a loose component, a tank for a liqiud component with a spring-loaded valve built therein, a proportioner of the liquid component, made in the form of a plunger pump and geared to the loose-component proportioner. This type of sand-conditioning machine is reliable in operation and simple in construction. This is made possible through the provision of kinematic linkage between the proportioners of the sand loose and liquid components. Owing to this kinematic linkage or gearing, the proportioning of the sand components is effected simultaneously with the aid of one drive, which substantially reduces the number of mechanisms in the machine. In addition, it becomes unnecessary to carry out automatic control over the portion of each component introduced into the mixer per operating cycle, as the preset ratio thereof is ensured and remains intact in the event of failure in the operation of automatic system.

However, the aforedescribed sand-preparing machine requires that the liquid-component proportioner be thoroughly and regularly washed in the course of operation. The reason for this lies in that the binder, of the composition being a part of a fluidized sand and its liquid component, possesses rather strong adhesive capacity and is capable of forming strong films highly adhesive to the surfaces with which the binder is brought in contact. Therefore, the liquid-component proportioner should be constructed so as to permit the friction members to be arranged without the reach of the binder. This is done to preclude the formation of strong films in the gap between the friction members, which may bring about a failure in the operation of the proportioner or upset its metering accuracy.

SUMMARY OF THE INVENTION

It is the primary object of the invention to provide a sand-preparing apparatus which will be reliable in operation and will ensure preset portions of liquid components to be delivered at any time.

Another object of the invention is to provide a sand-preparing apparatus which is simple in construction and easy in operation.

These and other objects of the invention are accomplished by the provision of an apparatus for the preparation of a fluidized sand, comprising containers for loose components of said sand, containers for liquid components with spring-loaded valves built therein, feeders intended for feeding and metering the sand components to be intermixed, said feeders being interconnected with one another by means of a drive, and a mixer, wherein, according to the invention, the container for each liquid component is provided with an actuator intended for effecting forcible opening of the container spring-loaded valve, and having a control device and an eccentric mounted on a shaft of the drive for actuating the feeders and acting on this control device, each liquid-component feeder being provided with spring-loaded diaphragms, of which one is adapted to control the feeder for loose components, the other being used to close an outlet of the feeder.

The connection between the feeders is preferably made in the form of an intermediary member connected with the spring-loaded diaphragm and brought in contact with a cam mounted on a shaft of the drive for actuating the feeders and set at an angle of 2 to 15 degrees relative to the eccentric.

The invention essentially resides in the following.

As the shaft of the drive for actuating the feeders rotates, the eccentric acts on the device adapted to control the actuator of the spring-loaded valve. The latter is opened to communicate the cavity of the liquid-component container with the working chamber of the feeder. The sand liquid component fills the chamber of the feeder, as the latter increases in volume with the release of the spring in the pressure diaphragm. Thereafter, the spring-loaded valve is tightly closed, thereby reliably isolating the feeder chamber from the container, while the pressure diaphragm, geared to the loose-component feeder, is caused to move into the interior of the working chamber, thus reducing the latter in volume. Under the action of pressure established in the working chamber, the press-out diaphgragm is operable to open the feeder outlet through which a preset portion of the sand liquid component, the value of which is in direct proportion to the stroke of the pressure diaphragm, is delivered to the mixer. At the end of the pressure-diaphragm stroke, the spring-loaded valve is actuated to communicate the feeder working chamber with the container, and the cycle is resumed. With each revolution of the driven shaft, a preset amount of the sand liquid and loose components is fed to the mixer, which amount depends on specific requirements and is regulated independently.

A special stress should be laid on the necessity of effecting timely opening and closing of the spring-loaded valve and on the importance of thorough control over the initial moment in the on-and-off cycles of the spring-loaded valve actuator effected by means of the eccentric mounted on the shaft of the feeder drive.

The provision of a plurality of diaphragms in the feeder and the spring-loaded valve working chamber construction makes it possible to completely preclude the use of friction pairs operating in the medium of the binder, and to render the apparatus much more simple in construction and more reliable in operation. The provision of actuators for effecting forced opening of the spring-loaded valves permits preset portions of the sand liquid component fed to the mixer to be regulated, thereby making it possible to regulate parameters of the finished sand delivered from the mixer.

The absence of actuators for forced opening of the spring-loaded valves leads to a gradual change in the amount of preset portions of the sand liquid components. The reason for this is insufficient rigidity of the valve actuating spring. With the valve not sitting tightly on the seat, the sand liquid component penetrates partially through the resultant clear gaps into the container as pressure is mounting in the working chamber of the feeder. However, the slightest increase in the force of the valve pressure on the seat results in the deformation of the pressure diaphragm, with the sand liquid component being sucked out of the container to pass into the working chamber of the feeder, and imposes more stringent requirements on the tightness of the container and-feeder system. Deformation of the diaphragm will invariably lead to a decreased amount of a portion fed and metered by the feeder; which amount may even drop to zero, since it is much easier, with sufficiently rigid valve spring, to bring about expansion of the diaphragm than compression of the spring.

The apparatus of the invention is readily adapted for automatic operation and can be easily incorporated in any automatic line for the manufacture of moulds and cores from fluidized sands.

BRIEF DESCRIPTION OF THE DRAWINGS

The invention will now be described, by way of example only, with reference to the accompanying drawings, wherein.

DETAILED DESCRIPTION OF THE PREFERRED EMBODIMENT

Figure 2:
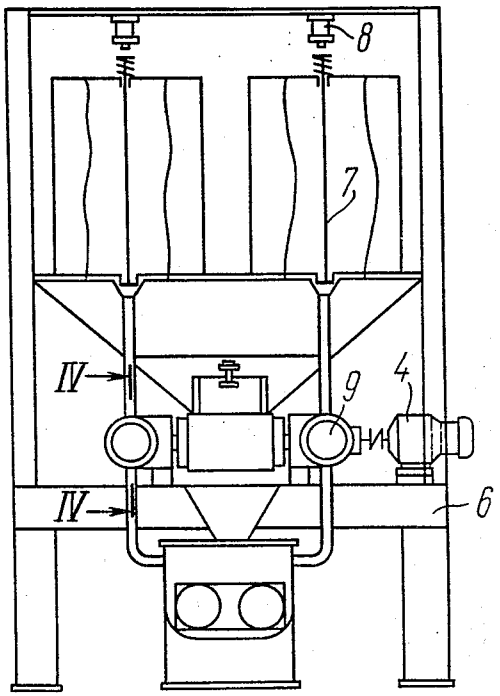
FIG. 2 is a view taken along arrow A of FIG. 1.
Figure 1:
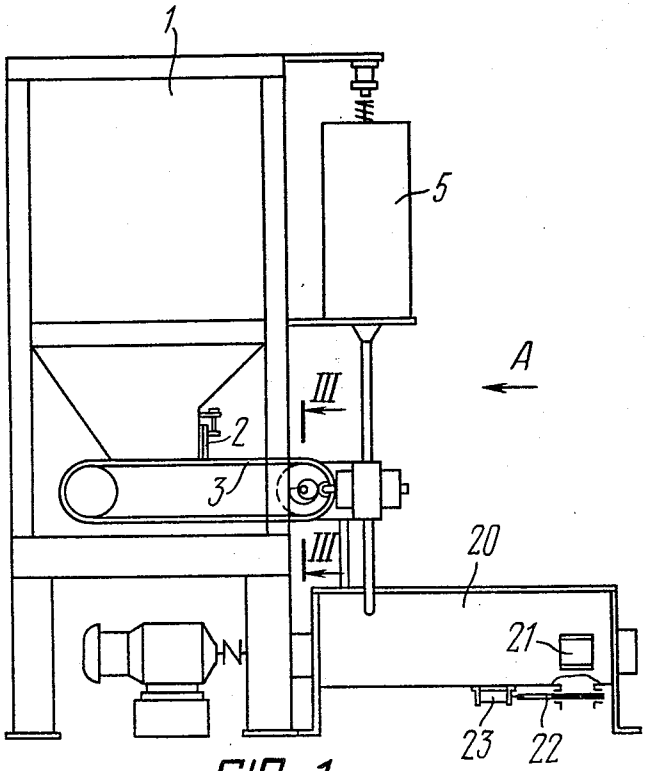
FIG. 1 is a general view of an apparatus for the preparation of a fluidized sand.
Figure 3:
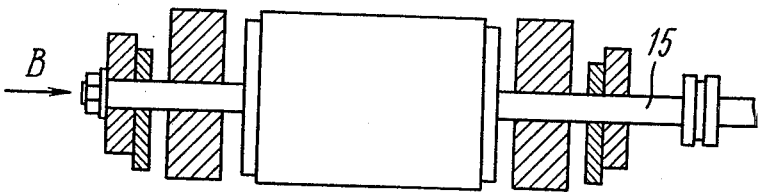
FIG. 3 is a cross section III—III of FIG. 1.
Figure 5:
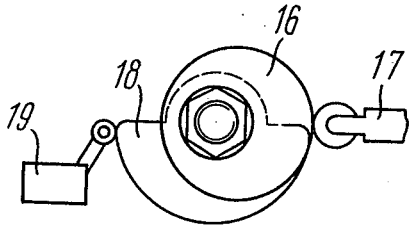
FIG. 5 is a view taken along arrow B of FIG. 3.
Figure 4:
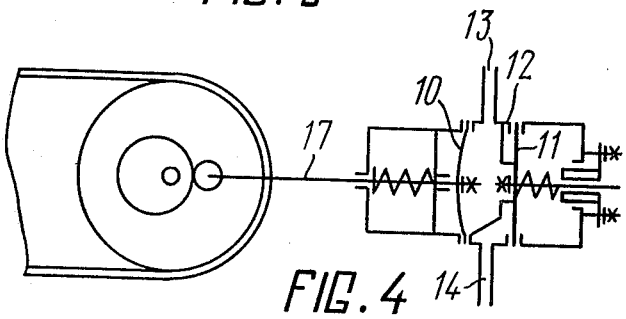
FIG. 4 is a cross section IV—IV of FIG. 2.

Referring now to the above drawings and to FIG. 1 in particular, there is shown therein an apparatus for the preparation of a fludized sand, which comprises a container I for loose materials with a gate 2, a belt feeder 3 with a drive 4, serving as a proportioner of loose materials and arranged or located under the container 1, containers 5 for liquid components, fixed on a support frame 6 and provided with spring-loaded valves 7 and actuators 8 for effecting forced opening of the latter, proportioners 9 for liquid components, provided with a spring loaded pressure diaphragm 10 and a spring-loaded press-out diaphragm 11, as well as with a housing 12, inlet 13 and outlet 14. Mouted on a driven shaft 15 of the feeder 3 are cams 16 brought in contact with an intermediary member 17 connected with the pressure diaphragm 10, and eccentrics 18 acting on devices 19 adapted to control the actuators 8. The eccentrics 18 are set at an angle of 2 to 15 degrees relative to the cams 16, which angular arrangement allows the control devices 19 to be actuated after the pressure diaphragm 10 discontinues its movement into the interior of the proportioner 9, and when the pressure diaphragm 10 resumes its movement into the interior of the feeder 9 with the control devices 19 cut out. An increase in the angle for a value for more than 15 degrees will lead to a substantial degree of exapansion of the diaphragms 10, which will soon become inoperative, and to a higher probability of air suction into the working chamber of the proportioners due to other evacuation.

A decrease in the angle for a value of more than 2 degrees will lead to failure in the metering accuracy, since it becomes impossible to completely prevent the penetration of the sand liquid component to the mixer directly from the vessel while feeding a portion thereof.

By turning the cam 16 relative to the driven shaft 15, it becomes possible to regulate the amount of the liquid component portion fed by means of the proportioner 9 to the mixer 20. The portion of the liquid component is regulated by vertical displacement of the gate 2. The mixer 20 is provided with an outlet 21, a damper 22 and a cylinder 23.

The apparatus of the invention operates as follows.

A loose component is fed to the mixer 20 through a slit, formed by the gate 2, by means of the belt feeder 3 actuated by the drive 4. The amount of the loose material fed to mixer 20 is regulated by setting the gate 2 in an appropriate position.

As the driven shaft 15 rotates, the cams 16 are operable to act through the intermediary members 17 on the diaphragms 10. As a result of this, pressure is mounted in the working chamber of the proportioner 9, the working chamber is reduced in volume and the liquid component, pressing out the diaphragm 11 through the outlet 14 in the housing 12, is discharged into the mixer 20. After the intermediary members 17 have been released by the cams 16, the diaphragms II are operable to close the outlets 14, the eccentrics 18 are operated to cut in the control devices 19, and actuators 8, are operable to open the valves 7, thereby permitting the liquid component to freely fill the working chambers of the proportioners 9, passing therethrough from the containers 5 via the inlets 13. Under the action of the springs the diaphragms 10 return to their original position, thereby increasing to the maximum the volume of the working chambers of the proportioners 9. As this happens, the eccentrics 18 are operable to cut out the control devices 19, the actuators 8 release the valves 7 which are tightly closed under the action of springs, thus ensuring reliable isolation of the feeders and vessels. In the course of rotation of the driven shaft 15, the cams 16 act through the intermediary members 17 on the diaphragms 10 once again, and the cycle is resumed. The thus prepared sand is delivered through the outlet 21. On completion of the operation, the residue of the sand is discharged through the open damper 22 actuated by the cylinder 23. The prepared sand is further delivered directly or through an intermediary container to the metering chamber of an automatic equipment for the production of cores or moulds.

The apparatus of the invention is simple in construction and easy in operation, also ensuring the accuracy in feeding and metering portions of initial material fed to the mixer. The apparatus can find most utility where large-lot or mass-production operation is required.

What is claimed is:

1. An apparatus for the preparation of the fluidized sand for use in foundry practice, comprising:

a container for loose components; containers for liquid components, having spring-loaded valves built therein; an actuator for effecting forced opening of each of said spring-loaded valves, and a means for controlling said actuator; feeders for feeding and metering the materials to be mixed, said feeders being connected with one another, a drive of said feeders; an eccentric mounted on a shaft of said drive of the feeders and acting on the said control device; each of said liquid-component feeders having spring-loaded diaphragms, one of which is adapted to control the loose-component feeder and the other is used to close an outlet from the liquid-component feeder.

2. An apparatus as claimed in claim 1, wherein the connection between the feeders is effected through an intermediary member connected with the spring-loaded diaphragm and brought in contact with a cam mounted on a shaft of the drive of said feeders and set at an angle of 2 to 15 degrees relative to said eccentric.

* * * * *